US005965342A

United States Patent [19]

Lau et al.

[11] Patent Number: 5,965,342

[45] Date of Patent: Oct. 12, 1999

[54] PHOTOGRAPHIC ELEMENTS CONTAINING SPECIFIED CYAN DYE-FORMING COUPLERS FOR IMPROVED HEAT AND LIGHT STABILITY

[75] Inventors: Philip T. Lau; Stanley W. Cowan, both of Rochester, N.Y.

[73] Assignee: Eastman Kodak Company, Rochester, N.Y.

[21] Appl. No.: 08/960,934

[22] Filed: Oct. 30, 1997

[51] Int. Cl.[6] ..... G03C 7/30; G03C 7/32; G03C 7/34

[52] U.S. Cl. ..... 430/553; 430/552; 430/557; 430/558

[58] Field of Search ..... 430/552, 553, 430/557, 558

[56] References Cited

U.S. PATENT DOCUMENTS

| | | | |
|---|---|---|---|
| 3,998,642 | 12/1976 | Lau et al. | 430/553 |
| 4,828,970 | 5/1989 | Kuse et al. . | |
| 5,397,688 | 3/1995 | Yoshioka | 430/557 |
| 5,576,150 | 11/1996 | Tang et al. | 430/558 |

FOREIGN PATENT DOCUMENTS

| | | |
|---|---|---|
| 0554027 | 8/1993 | European Pat. Off. . |
| 62-196657 | 8/1987 | Japan . |

*Primary Examiner*—Janet Baxter
*Assistant Examiner*—Amanda C. Walke
*Attorney, Agent, or Firm*—Arthur E. Kluegel

[57] ABSTRACT

The invention provides a photographic element comprising a silver halide emulsion layer having associated therewith a cyan dye-forming coupler having the formula:

wherein $R_3$ represents a methyl or ethyl group; $R_4$ represents an alkyl or alkenyl group containing 8 or more carbon atoms; $R_5$ represents an alkyl or alkenyl group containing 4 or more carbon atoms; X represents a chloro or fluoro group; Y represents a substituent group and n represents an integer from 0 to 4, provided that if n is 2 or more, then two Y groups may be joined together to form a ring; and Z represents hydrogen or a group capable of being split off by oxidized color developer. The dye formed by the coupler upon conventional processing with a p-phenylenediamine developer exhibits improved stability.

9 Claims, No Drawings

PHOTOGRAPHIC ELEMENTS CONTAINING SPECIFIED CYAN DYE-FORMING COUPLERS FOR IMPROVED HEAT AND LIGHT STABILITY

FIELD OF THE INVENTION

The present invention relates to a color photographic element containing a red-sensitive layer containing a silver halide emulsion associated with a specific cyan coupler. More specifically, this invention relates to such an element containing a 2-acylamino-5-alkyl-6-halophenol cyan coupler with particular alkyl substituents on the 2-acylamino group.

BACKGROUND OF THE INVENTION

In recent years, a great deal of study has been conducted to improve dye-forming couplers for silver halide photosensitive materials. While many significant advances have been reported, the best couplers available today still have serious deficiencies. In particular, improving the stability of the image dyes derived from cyan couplers has proven to be very difficult.

The couplers commonly used to form cyan image dyes in color films and papers are generally of three types: amides of 1-hydroxy-2-naphthoic acid as represented by formula (I) and described in U.S. Pat. Nos. 2,313,138; 4,208,210; 5,283,163; 5,380,638; 5,476,757; and 5,457,020; 2,5-diacylaminophenols as described by formula (II) and described in U.S. Pat. Nos. 2,369,929; 2,895,826; 3,466,622; 3,758,308; 3,864,366; 3,880,661; 3,996,253; and 4,333,999; and 2-acylaminophenols as described by formula (III) and described in U.S. Pat. Nos. 2,367,531; 2,369,929; 2,423,730; 2,801,171; 3,772,002; 3,998,642; and 4,560,630. These types of couplers can be used either by being incorporated in the photographic silver halide emulsion layers or externally in the processing baths. In the former case the couplers must have ballast substituents built into the molecule to prevent the couplers from migrating from one layer to another.

(I)

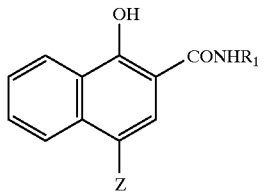

(II)

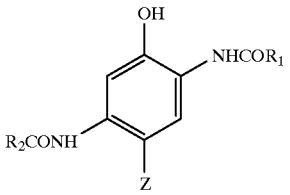

-continued (III)

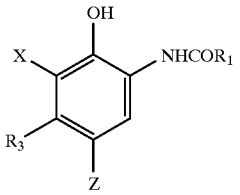

In each of the formulas (I), (II) and (III), $R_1$ represents an alkyl, aryl or arylamino substituent and Z represents a hydrogen atom or a group which is split off during the coupling, reaction ("coupling-off group"). In (II), $R_2$ represents an alkyl or aryl substituent, usually an alkyl group substituted at the alpha position by an aryloxy group. In (III), $R_3$ represents an alkyl group, usually methyl or ethyl, and X represents a halogen atom, usually chlorine or fluorine.

Although the couplers of formulas (I) and (II) have been used extensively in color photographic film products, the dyes derived from each of the three types suffer from various deficiencies that make them unsatisfactory for use in color photographic papers. The couplers of Formula (III) are commonly used in color photographic papers, but they nevertheless have serious shortcomings that will impose limitations on their use in future paper products that will have much more stringent requirements.

Couplers of Formula (I) yield image dyes that have poor stability to heat, humidity, light, and ferrous ions that are present in the bleaching solution. Furthermore, the absorption spectra of their image dyes are too bathochromically shifted (that is, shifted too far toward the long wavelength portion of the spectrum) to be useful in color photographic paper, and the dyes have an unacceptable side absorption in the short wavelength portion of the spectrum.

The image dyes derived from couplers of the 2,5-diacylaminophenol Formula (II) have excellent stability to heat and humidity, but they have poor stability to light. Furthermore, while the short-wavelength side absorption of these dyes is sharper-cutting than in the case of formulas (I) and (II) the hues of the dyes are too hypsochromically shifted (that is, shifted too far toward the short wavelength portion of the spectrum) if $R_1$ is alkyl or aryl, and too bathochromically shifted (toward longer wavelengths) if $R_1$ is arylamino, to be useful in color photographic paper.

The couplers of the 2-acylaminophenol Formula (III), more specifically those of Formula (IV), are used in nearly all commercially available color photographic papers. The couplers of this type that have been commercially used may be divided into two groups according to the substituent group $R_3$. When $R_3$ is a methyl group, the image dyes have excellent light stability but suffer from insufficient stability to heat and humidity to meet the requirements of modern products; on the other hand, when $R_3$ is an ethyl group, the stability to heat and humidity is greatly improved but light stability is unsatisfactory. Even when $R_3$ is an ethyl group, the stability to heat and humidity is not good enough to satisfy the stringent requirements of future color papers.

(IV)

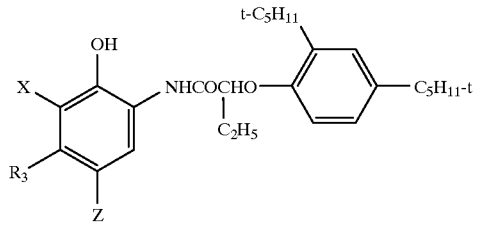

Examples of these couplers are shown in U.S. Pat. No. 4,828,970 and in EP 554,027 but none of the $R_4/R_5$ substituent combinations disclosed provides satisfactory results.

A problem to be solved is to provide a color photographic element containing a silver halide emulsion layer having associated therewith a cyan dye forming coupler that forms a more stable dye than heretofore obtainable.

SUMMARY OF THE INVENTION

The invention provides a photographic element comprising a silver halide emulsion layer having associated therewith a cyan dye-forming coupler having the formula:

(V)

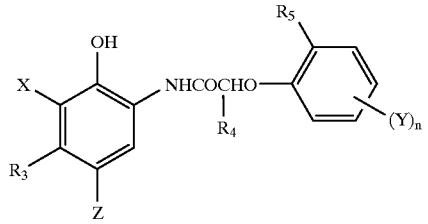

wherein $R_3$ represents a methyl or ethyl group;

$R_4$ represents an alkyl or alkenyl group containing 8 or more carbon atoms;

$R_5$ represents an alkyl or alkenyl group containing 4 or more carbon atoms;

X represents a chloro or fluoro group;

Y represents a substituent group and n represents an integer from 0 to 4, provided that if n is 2 or more, then two Y groups may be joined together to form a ring; and Z represents hydrogen or a group capable of being split off by oxidized color developer.

The dye formed by the coupler upon conventional processing with a p-phenylenediamine developer exhibits improved dye stability.

DETAILED DESCRIPTION OF THE INVENTION

The invention may be generally described as in the Summary of the Invention. The coupler of the invention is more particularly described as follows. In Formula (V), $R_3$ represents a methyl or ethyl group. Other alkyl groups larger than ethyl have been found to degrade coupling activity.

$R_4$ represents an alkyl or alkenyl group containing 8 or more carbon atoms. The group may be linear or branched, saturated or unsaturated and is preferably a linear, saturated alkyl group containing 16 or more carbon atoms, such as hexadecyl or eicosyl. The alkyl group may be substituted as provided hereinafter.

$R_5$ represents an alkyl or alkenyl group containing 4 or more carbon atoms. It may be linear or branched, saturated or unsaturated, and is desirably a tertiary alkyl group including one having 4 to 8 carbon atoms such as t-butyl, t-pentyl, or t-octyl.

X represents a chlorine or fluorine atom, typically a chlorine atom.

Each Y represents a substituent group as defined hereinafter. Desirably, at least one Y represents an alkyl or alkenyl group such as a linear or branched, saturated or unsaturated, substituted or unsubstituted alkyl or alkenyl group of 4 to 8 carbon atoms, and more preferably a tertiary alkyl group such as a t-butyl, t-pentyl, or t-octyl group. "n" represents an integer from 0 to 4, preferably 1. If n is larger than 1, then the substituents Y may be the same or different, and two substituents Y may be joined together to form a carbocyclic or heterocyclic ring.

Z represents a hydrogen atom or a group which can be split off by the reaction of the coupler with an oxidized color developing agent, known in the art as a "coupling-off group." The presence of hydrogen at the coupling site (the site on the coupler molecule at which Z is attached) provides a 4-equivalent coupler, and the presence of a coupling-off group other than hydrogen usually provides a 2-equivalent coupler. Representative classes of such coupling-off groups include, for example, chloro, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patents and published applications 1,466,728, 1,531,927, 1,533,039, 2,066,755A, and 2,017,704A, the disclosures of which are incorporated herein by reference. Halogen, alkoxy and aryloxy groups are most typically employed. Preferably, Z is a chlorine or fluorine atom, and most preferably Z is the same as X.

The following examples further illustrate the couplers of the invention. It is not to be construed that the present invention is limited to these examples.

C-1

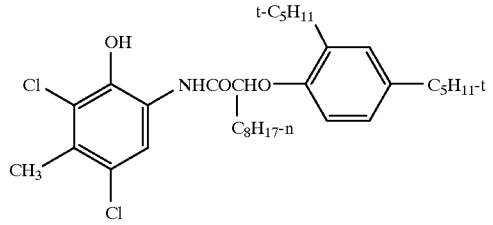

C-2

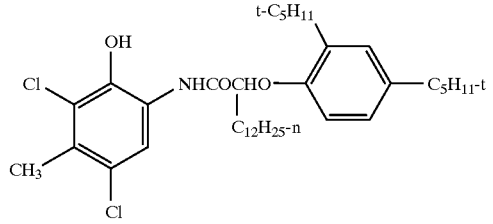

-continued
C-3
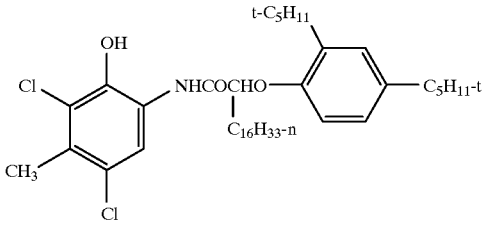
C-4
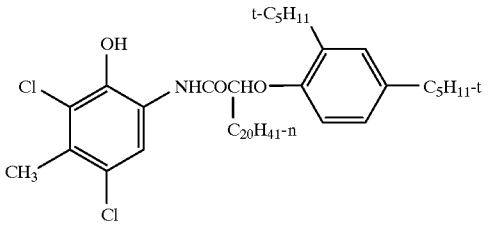
C-5
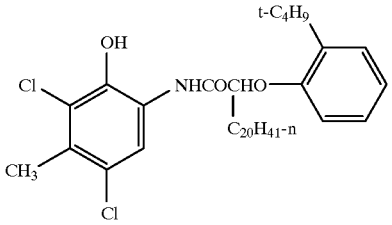
C-6
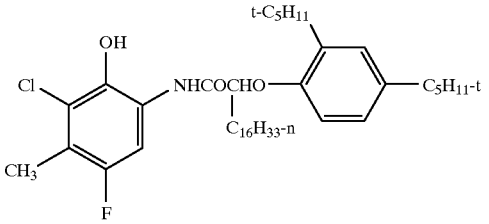
C-7
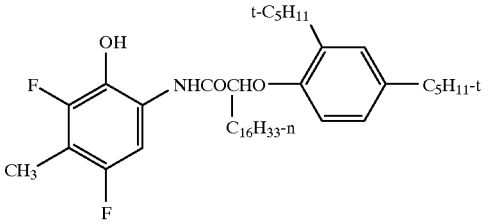
C-8
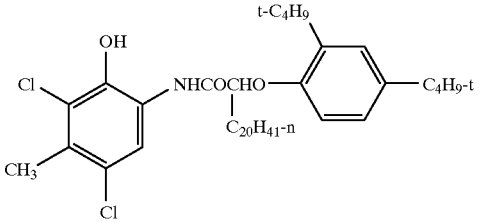
-continued
C-9
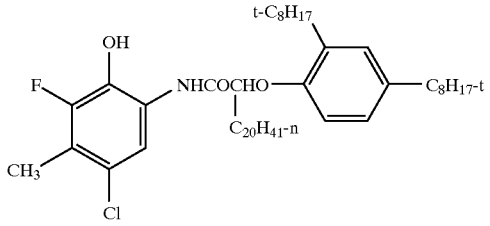
C-10
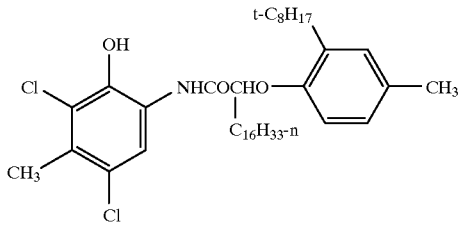
C-11
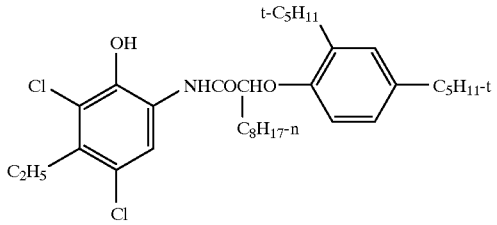
C-12
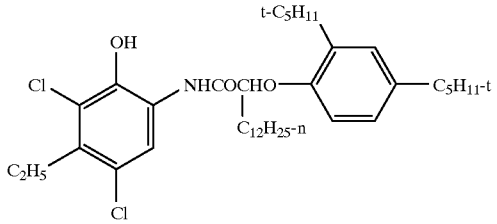
C-13
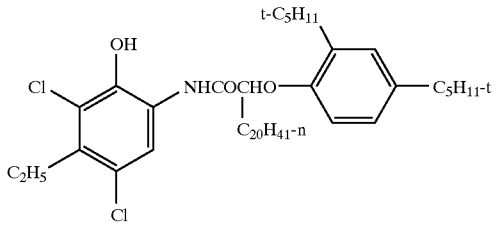
C-14
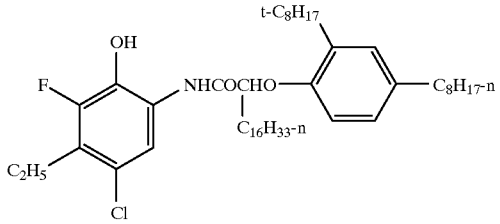

-continued
C-15
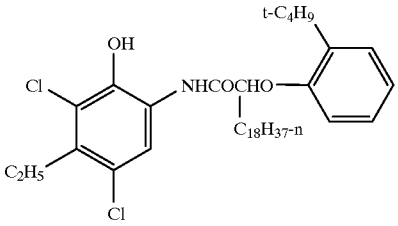
C-16
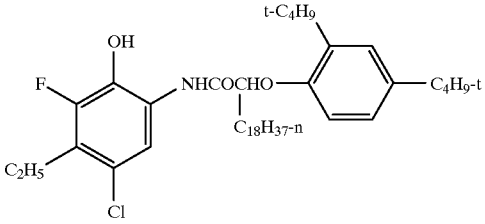
C-17
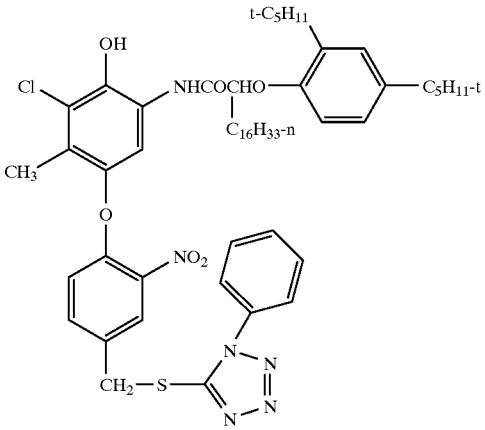
C-18
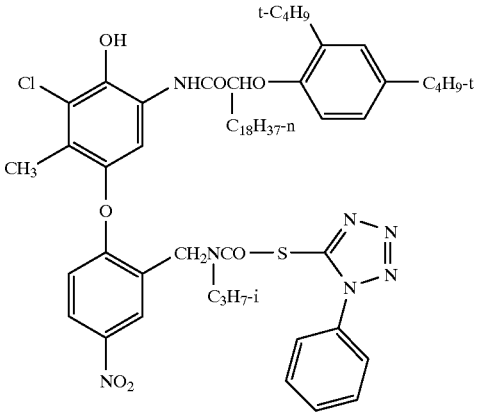
C-19
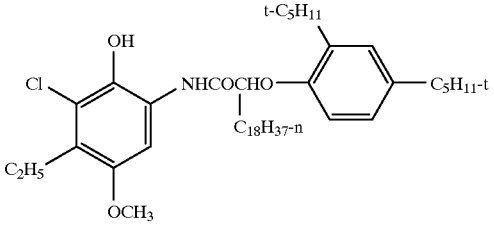
C-20
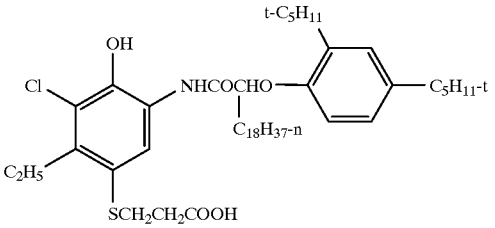
C-21
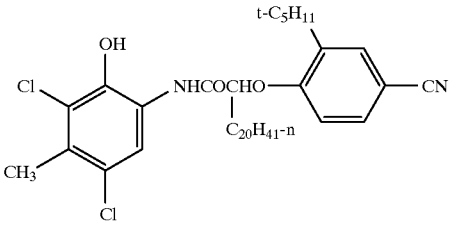
C-22
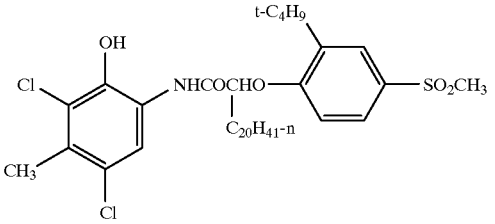
C-23
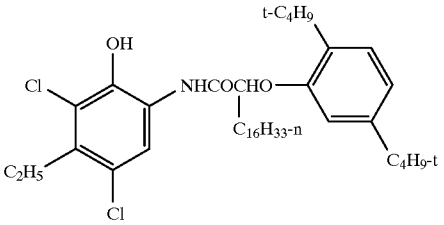
C-24
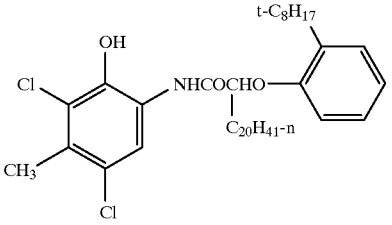
C-25
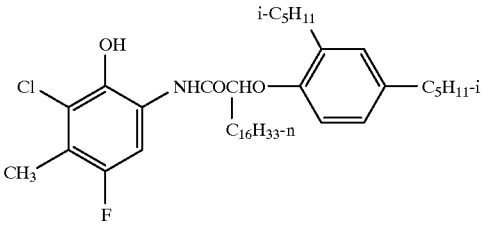

-continued

C-26

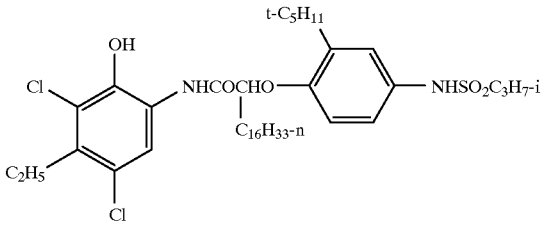

C-27

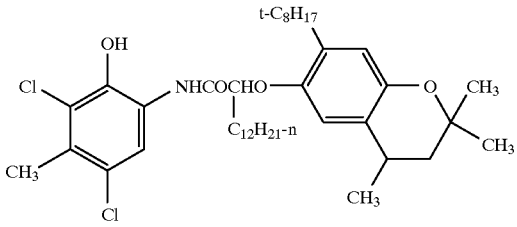

Unless otherwise specifically stated or when the term "group" is used, it is intended throughout this specification, when a substituent group contains a substitutable hydrogen, to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted. In view of the longer chain lengths specified for the substituent of the inventive coupler, it is possible to select these substituents so as not to require a separate ballast.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378

898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers. Indeed, the coupler of the invention may release such PUGs.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095, 984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

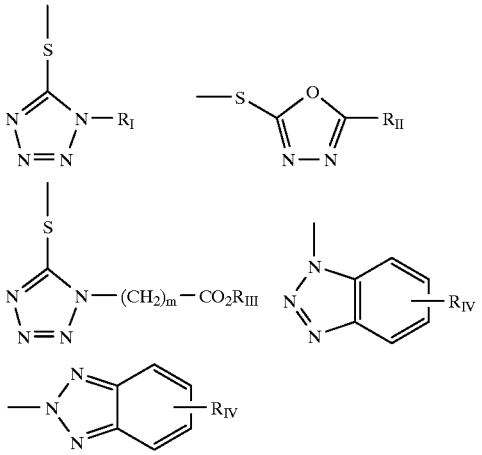

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the instant or time-delayed release of the PUG such as groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

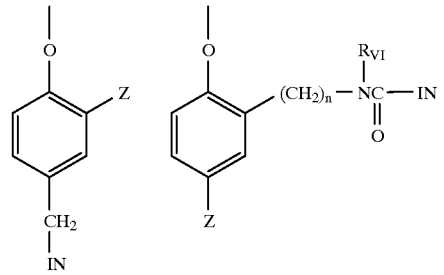

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1
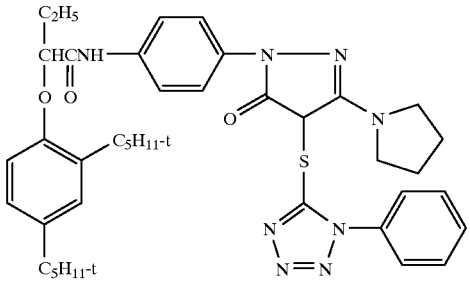
D2
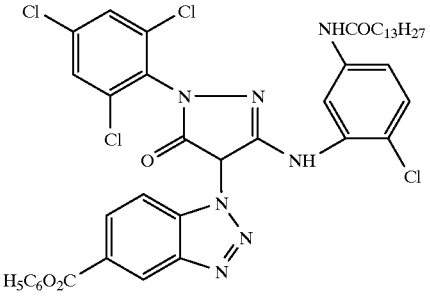
D3
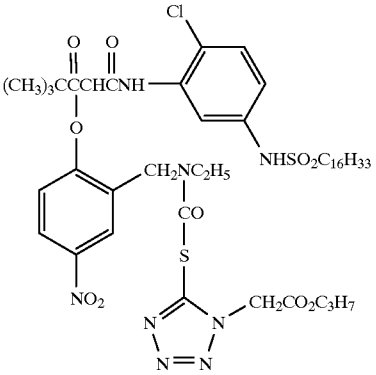
D4
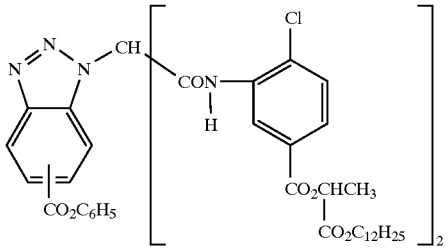
D5
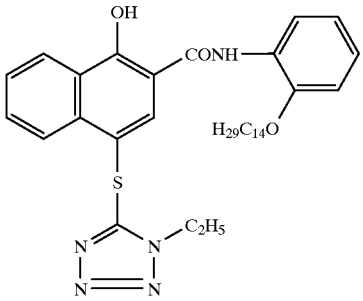
-continued
D6
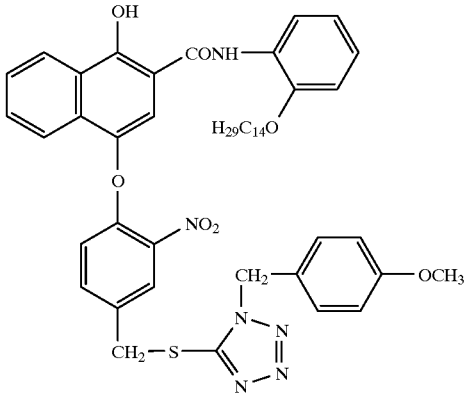
D7
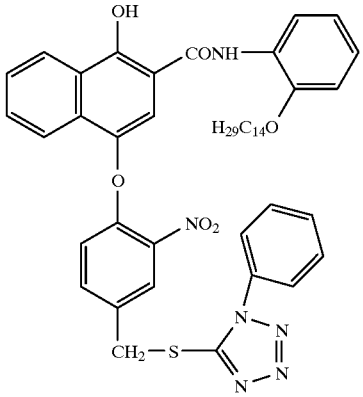
D8
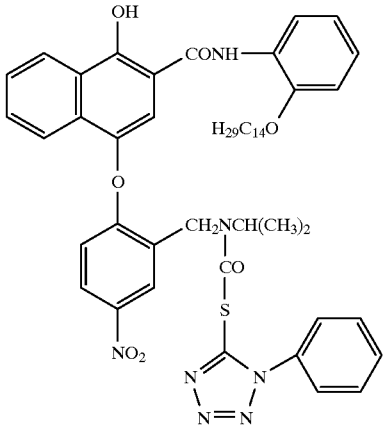

-continued

D9

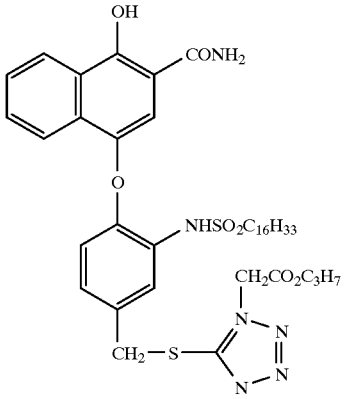

D10

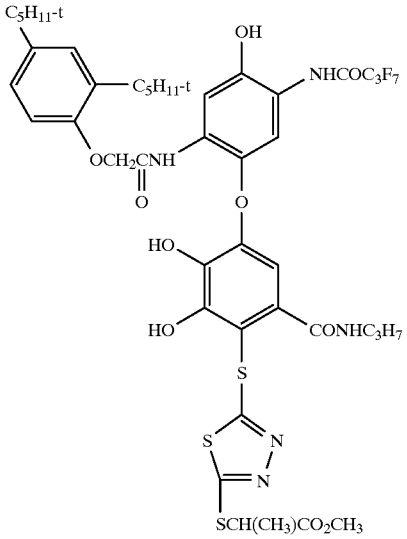

D11

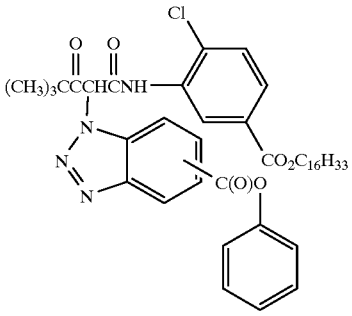

-continued

D12

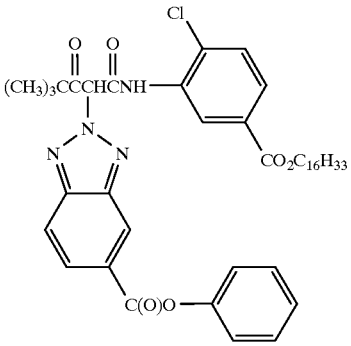

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions consisting predominantly of silver chloride are useful and are described, for example, in U.S. Pat. Nos. 5,310,635; 5,320,938; and 5,356,764.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

SYNTHETIC EXAMPLES

Cyan couplers of this invention can be readily prepared by reacting an α-aryloxyalkyl acid chloride ballast with an aminophenol such as 2-amino-5 -methyl-4,6-dichlorophenol. The synthesis of cyan coupler C-4 will further illustrate the invention.

Preparation of 2-(2,4-di-t-amylphenoxy)docosanoic acid ballast

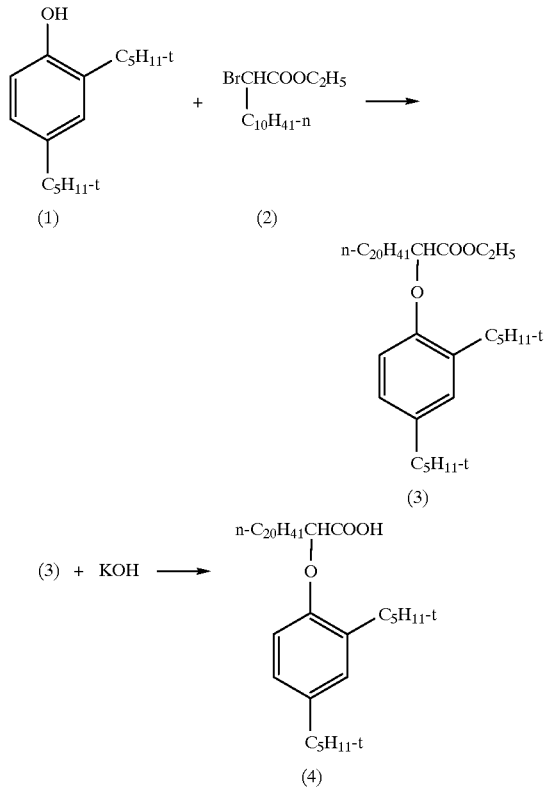

To a stirred suspension of 14.1 g (0.352 mol) of a 60% dispersion of NaH in 300 ml dry DMF was added 82.5 g (0.352 mol) of 2,4-di-t-amylphenol (1) and 143.2 g (0.320 mol) of ethyl 2-bromodocosanoate (2). The mixture was heated with stirring on a steam bath for 4 hours. After cooling to room temperature, the mixture was poured into ice water containing 10 ml conc. HCl. The oil which separated was extracted with heptane. The extracts were dried over $MgSO_4$ and then chromatographed through a short silica gel column, eluting first with heptane and finally with a 25% $CH_2Cl_2$/heptane solvent mixture. The fractions containing the product were combined and the solvent removed under reduced pressure to give 135.6 g (70.5%) of pale yellow oil whose structure corresponded to compound (3).

The oil (135.6 g, 0.226 mol) obtained above was dissolved in a solvent mixture of 200 ml THF and 200 ml MeOH. With stirring, a solution of 16.8 g (0.300 mol) KOH in 75 ml water was added portionwise. The mixture was stirred at room temperature for 30 minutes then refluxed for 2 hours. After cooling to room temperature the mixture was poured into ice water containing 20 ml conc. HCl. The oil which separated was extracted with EtOAc, dried over $MgSO_4$, and the solvent removed under reduced pressure to give 129 g (100%) of product (4) as an oil, which slowly solidified to a white waxy solid upon standing at room temperature.

Preparation of cyan coupler C-4

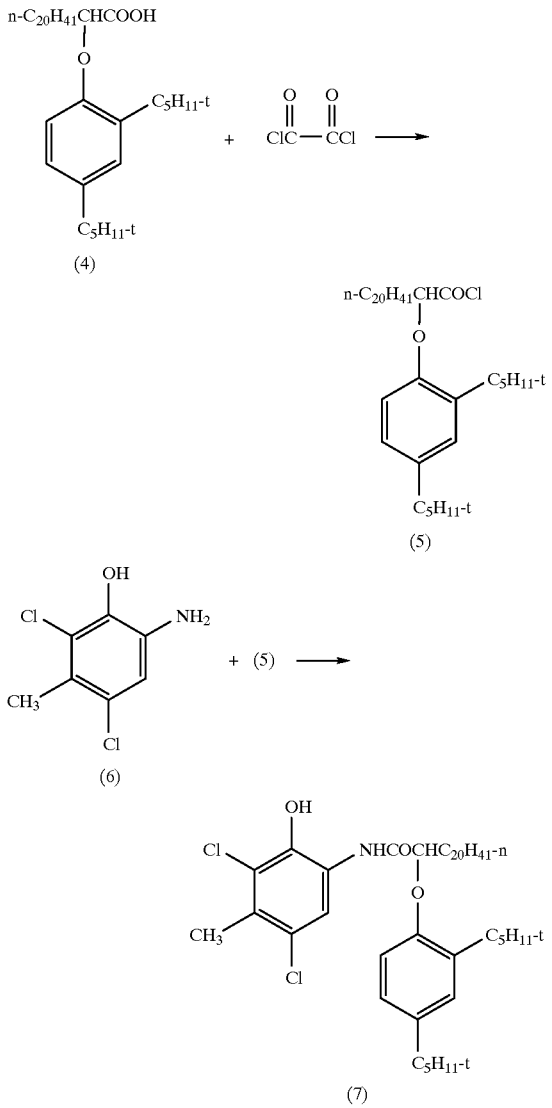

To a solution of 17.8 g (0.031 mol) of 2-(2,4-di-t-amylphenoxy)docosanoic acid (4) in 50 ml $CH_2Cl_2$ was added with stirring 12.7 g (0.10 mol) of oxalyl chloride and 5 drops of DMF. After stirring at room temperature for 2 hours the solvent and excess oxalyl chloride were removed under reduced pressure. The residual acid chloride (5) was taken up in 25 ml THF and added to a stirred solution of 5.8 g (0.03 mol) of 2-amino-5-methyl-4,6 -dichlorophenol (6) and 7.3 g (0.06 mol) of N,N-dimethylaniline in 150 ml THF. The mixture was stirred at room temperature for 3 hours then poured into ice water containing 5 ml conc. HCl. The solid which separated was collected, washed with water, and recrystallized from EtOH to give 19.7 g (88%) of white crystalline solid whose structure was shown by $H^1$NMR and elemental analysis to be compound (7) corresponding to cyan coupler C-4 of the invention, m.p. 66–67° C.

Calc. for $C_{45}H_{73}Cl_2NO_3$: C, 72.36; H, 9.85; N, 1.88; Cl, 9.49 Found: C, 72.35; H, 9.58; N, 1.89; Cl, 9.20

Preparation of Photographic Elements

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of red-sensitized silver chloride emulsion containing 0.19 g silver, a dispersion containing $8.61\times10^{-4}$ mole of the coupler indicated in Table 1, and 0.043 gram surfactant Alkanol XC (trademark of E. I. Dupont Co.)(in addition to the Alkanol XC used to prepare the coupler dispersion). The coupler dispersion contained the coupler, all of the gelatin in the layer except that supplied by the emulsion, an amount of dibutyl phthalate equal to the weight of coupler, and 0.22 gram Alkanol XC.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

Preparation of Processed Photographic Examples

Processed samples were prepared by exposing the coatings through a step wedge and processing as follows:

| Process Step | Time (min.) | Temp (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetra acetate | 48.58 g |
| Ethylenediaminetetraacetic acid | 3.86 g |
| pH adjusted to 6.7 at 26.7 C | |

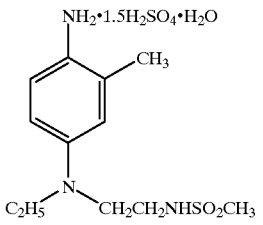

(Dev-1)

The dye stabilities of dyes formed from couplers of our invention were tested. The stabilities of the dyes to heat were measured as follows. The density of each step of each strip was measured. The strips from the examples in Table 1 were then incubated for two weeks in an oven in which the temperature was maintained at 75° C. and the relative humidity was maintained at 50%. The strips from the examples shown in Table 2 were treated similarly except that the incubation time was eight weeks. The densities were again measured. The heat stabilities of the dyes were calculated as the density remaining from an initial density of 1.0, and relative heat stabilities were obtained by dividing the stability of each sample by that of the dye from comparison coupler CC-2 or CC-9. The relative stabilities ("Rel Heat Stab") are shown in Tables 1 and 2.

The stabilities of the dyes to light were measured as follows. The density of each step of each strip was measured. The strips were then covered by the protective filter strips described below and subjected to irradiation by the light of a xenon arc lamp at an intensity of 50 klux for four weeks. The densities were again measured. The stabilities of the dyes were calculated as the density remaining from an initial density of 1.0, and relative stabilities were obtained by dividing the stability of each sample by that of the dye from comparison coupler CC-2 or CC-9. The relative stabilities ("Rel Light Stab") are shown in Tables 1 and 2.

The protective filter strips comprised (1) an ultraviolet-absorbing layer containing (per square meter) 1.33 grams gelatin, 0.73 grams 2-(2H-benzotriazol-2-yl)-4,6-bis(1,1-dimethylpropyl)-phenol, 0.13 gram Tinuvin 326 (trademark of Ciba-Geigy), and 0.043 gram Alkanol XC, and (2) a protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate, coated on a cellulose acetate-butyrate support.

TABLE 1

| Invention or Comparison | Coupler | Rel Heat Stab | Rel Light Stab |
|---|---|---|---|
| Comparison | CC-1 | 0.86 | 0.96 |
| Comparison | CC-2 | 1.00 | 1.00 |
| Invention | C-1 | 1.22 | 0.98 |
| Invention | C-2 | 1.29 | 1.00 |
| Invention | C-3 | 1.35 | 0.94 |
| Invention | C-4 | 1.41 | 1.03 |
| Invention | C-5 | 1.14 | 0.99 |
| Comparison | CC-3 | 0.85 | 0.99 |
| Comparison | CC-4 | 0.89 | 0.99 |
| Comparison | CC-5 | 0.93 | 0.98 |
| Comparison | CC-6 | 0.76 | 1.06 |
| Comparison | CC-7 | 0.90 | 1.00 |

TABLE 2

| Invention or Comparison | Coupler | Rel Heat Stab | Rel Light Stab |
|---|---|---|---|
| Comparison | CC-8 | 0.93 | 0.98 |
| Comparison | CC-9 | 1.00 | 1.00 |
| Comparison | CC-10 | 1.03 | 1.00 |
| Invention | C-11 | 1.06 | 1.02 |
| Invention | C-12 | 1.07 | 1.03 |

It is clear from the results in Tables 1 and 2 that the heat stabilities of the image dyes derived from cyan couplers of Formula (V) are significantly improved over those of the dyes from any of the comparison couplers.

The desired improvement is obtained when the coupler of Formula (V) is an alkyl group of 8 or more carbon atoms, and $R_5$ is also an alkyl group, preferably a tertiary alkyl group, of 4 or more carbon atoms.

When the required $R_4$ is missing (comparison coupler CC-1 and CC-8) or smaller than 8 carbon atoms (comparison couplers CC-2, CC-9, and CC-10), the heat stability of the dye is poor. As the size of $R_4$ is increased to 8 or more carbon atoms (couplers C-1 to C-4 and couplers C-11 and C-12 of the invention), the heat stability of the dye is greatly increased.

When the group $R_5$ is missing in comparison couplers CC-3, CC-4, CC-5, and CC-7, and when comparison coupler CC-6 has a chlorine atom instead of an alkyl group in this position, the resulting dyes have poor heat stability. It is particularly interesting to compare the heat stability of the dye from coupler C-5 of the invention with that of the dyes from comparison couplers CC-3 and CC-7, which are isomers of C-5 but have the alkyl group moved to different positions on the benzene ring leaving $R_5$ vacant. The comparisons exhibit much poorer heat stability.

The presence of an additional group Y on the phenoxy ring is optional, although a tertiary alkyl group here offers a further improvement in heat stability and is therefore preferred. For instance, the dye from coupler C-5 of the invention, which meets the requirements for $R_4$ and $R_5$ but does not have a Y group, has better heat stability than any of the comparison couplers, but it is not as stable as the dyes from couplers C-1 through C-4, in which Y is a tertiary alkyl group.

Furthermore, the couplers of the invention substantially retain desirable photographic properties, such as ease of synthesis, coupling reactivity, solubility, and dispersibility; and the image dyes derived from the couplers likewise retain desirable properties such as hue and stability to heat, humidity, and light.

Comparison couplers CC-1 through CC-10 are like the couplers of the invention except that the substituent groups $R_4$ and $R_5$ are missing or do not meet the requirements of the invention.

CC-1

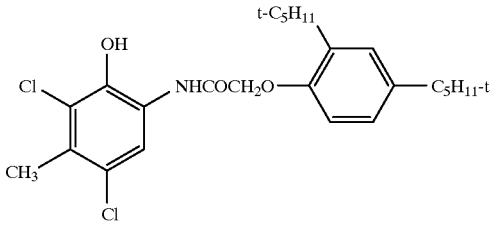

CC-2

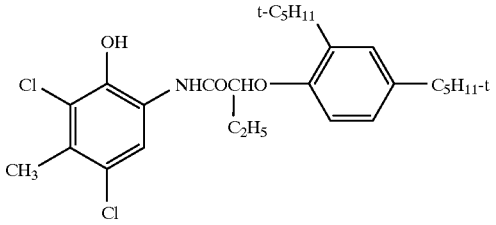

CC-3

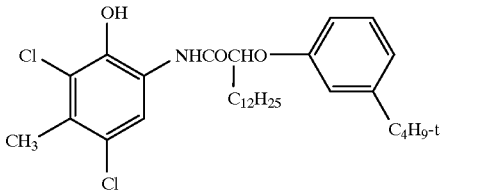

-continued

CC-4

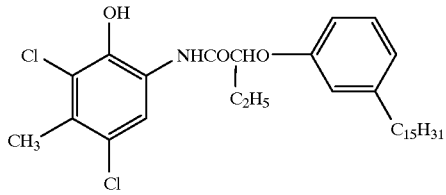

CC-5

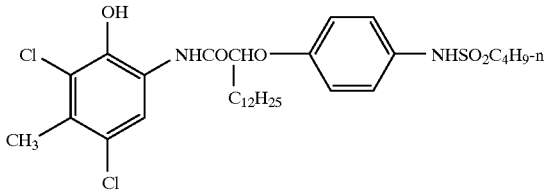

CC-6

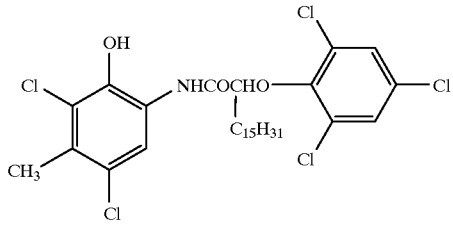

CC-7

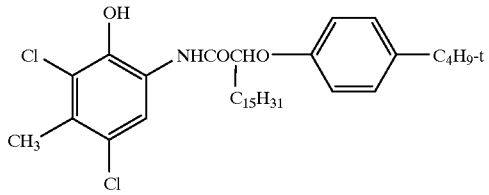

CC-8

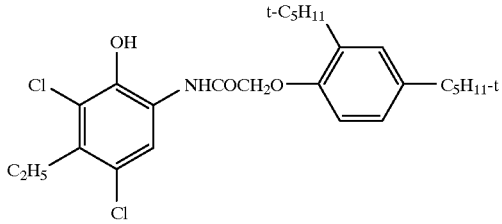

CC-9

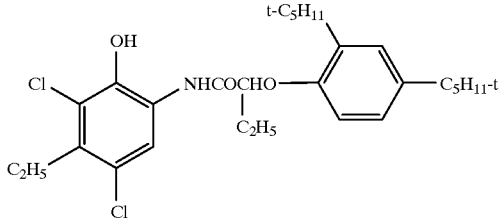

CC-10

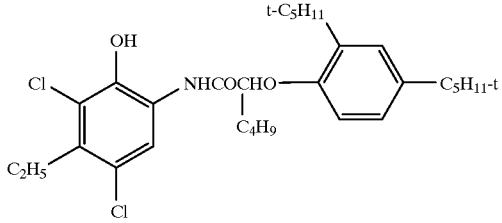

The entire contents of the patent applications, patents and other publications referred to in this specification are incorporated herein by reference.

What is claimed is:

1. A photographic element comprising a silver halide emulsion layer having associated therewith a cyan dye-forming coupler having the formula (V):

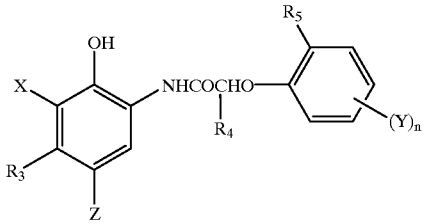

wherein $R_3$ represents an ethyl group;

$R_4$ represents an alkyl group that comprises at least 16 carbon atoms;

$R_5$ represents an alkyl group containing 4 or more carbon atoms;

X represents a chloro group;

Y represents a substituent group and n represents an integer from 0 to 4, provided that if n is 2 or more, then two Y groups may be joined together to form a ring; and Z represents hydrogen or a group capable of being split off by oxidized color developer.

2. The element of claim 1 wherein $R_4$ comprises at least 20 carbon atoms.

3. The element of claim 1 wherein $R_5$ contains from 4 to 8 carbon atoms.

4. The element of claim 1 wherein $R_5$ is a branched alkyl group.

5. The element of claim 4 wherein $R_5$ is selected from the group consisting of t-butyl, t-pentyl, and t-octyl groups.

6. The element of claim 1 wherein $R_5$ contains from 4 to 8 carbon atoms.

7. The element of claim 6 wherein $R_5$ is a branched alkyl group.

8. The element of claim 7 wherein $R_5$ is selected from the group consisting of t-butyl, t-pentyl, and t-octyl groups.

9. The element of claim 1 wherein n is 1 and Y is a branched alkyl or alkenyl group.

* * * * *